US005791737A

United States Patent [19]

Cochran

[11] Patent Number: 5,791,737

[45] Date of Patent: Aug. 11, 1998

[54] ELLIPTICAL DISC GRINDER

[76] Inventor: Gary Cochran, 3052 N. Forrest Lakes, Wichita, Kans. 67205

[21] Appl. No.: 799,340

[22] Filed: Feb. 13, 1997

[51] Int. Cl.[6] ..... E01C 23/088; E01C 23/09

[52] U.S. Cl. ..... 299/39.8; 299/87.1

[58] Field of Search ..... 299/39.1, 39.4, 299/39.8, 87.1; 404/90, 91

[56] References Cited

U.S. PATENT DOCUMENTS 3,732,023 5/1973 Rank et al. ..... 404/90

FOREIGN PATENT DOCUMENTS 1033353 7/1953 France ..... 404/90

*Primary Examiner*—David J. Bagnell

*Attorney, Agent, or Firm*—Kenneth Jack

[57] ABSTRACT

A grinder comprising an axle; a multiplicity of grinding teeth; and a plurality of grinding teeth suspending discs; the grinding teeth suspending discs being fixedly attached to the axle; each grinding tooth being fixedly attached to one of the grinding teeth suspending discs; the grinding teeth suspending discs fixedly suspending the grinding teeth around the rotatable axle; the grinding teeth suspending discs positioning the grinding teeth in an ellipse, so that each ellipse has a size, a shape, and a tilt with respect to the axle causing the orbital radiuses of the grinding teeth to be equal in length.

6 Claims, 4 Drawing Sheets

ELLIPTICAL DISC GRINDER

FIELD OF THE INVENTION

This invention relates to grinders in the form of a drum grinder having a multiplicity of cutting or grinding teeth or protrusions positioned in a cylindrical configuration for rotation about a central axis of rotation.

BACKGROUND OF THE INVENTION

Apparatus for grinding or planing away hard level surfaces such as asphalt roads or concrete roads commonly rotatably drive a grinding cylinder or drum, the exterior surface of the drum having a multiplicity of grinding or cutting protrusions. Such a grinding drum is commonly driven and controlled by an hydraulic cold planing machine which provides supporting and driving mechanisms for pressing the grinding drum against a flat surface to be ground or planed away, for rotatably driving the grinding drum causing its cutting teeth to impinge upon the surface to be ground away, and for moving the grinding drum in a forward motion along the surface being ground. Typically, such cold planing apparatus provide a protective shroud to shield against flying debris.

A drawback or disadvantage of such grinding drums is that pulverized asphalt or concrete debris tends to pile up in front of and behind the grinding drum as it moves forward, creating unwanted resistance to forward motion, and creating unwanted resistance to rotation of the drum.

The instant invention eliminates the problem of forward and rearward accumulation of pulverized debris and its resulting resistance to rotation, while preserving all of the benefits and advantages of a cylindrical "drum like" configuration of grinding teeth.

PRIOR ART PATENTS

U.S. Pat. No. 4,171,778 issued Oct. 23, 1979, to LeJeune discloses a grinding implement having a plurality of triangular cutting knives mounted over a rotatable axle.

U.S. Pat. No. 4,365,762 issued Dec. 28, 1982, to Hoshall discloses a blower having circular spiral discs mounted radially over a drive axle.

U.S. Pat. No. 4,607,799 issued Aug. 26, 1986, to Currie discloses a stone grinder comprising a plurality of irregularly shaped grinding discs mounted over a drive axle.

U.S. Pat. No. 4,895,309 issued Jan. 23, 1990, to Fritz discloses an impactor/metal grinder having a plurality of circular impact discs mounted over a drive shaft.

U.S. Pat. No. 5,439,182 issued Aug. 8, 1995, to Sgariboldi discloses an auger for moving and cutting fibrous product for preparation of animal feed.

U.S. Pat. No. 5,443,588 issued Aug. 22, 1995, to Loppoli discloses an auger cutter for preparation of animal feeds.

None of the above disclosed U.S. patents teaches, discloses, or describes the novel, useful, inventive and unique aspects of the instant invention.

SUMMARY OF THE INVENTION

The instant invention preferably comprises a cylindrical axle having four elliptical grinding discs centrally and axially mounted thereon. Each elliptical grinding disc has a centrally located elliptical aperture through which the cylindrical axle passes, the discs preferably being welded to the cylindrical axle at contact points between the interior wall of the aperture and the exterior wall of the cylindrical axle. A multiplicity of hardened grinding teeth suitable for grinding away concrete or asphalt are welded at evenly spaced intervals to the outer peripheral surfaces of the elliptical discs. The elliptical discs are tilted with respect to the axis of rotation of the cylindrical axle so that all cutting teeth attached to the outer peripheries of the discs orbit about the axle at a constant radius.

The tilted elliptical disc configuration has advantages over utilization of a drum as the supporting structure for the grinding teeth because tilted elliptical discs will allow pulverized debris to pass between the discs while a drum causes pulverized debris to accumulate in front of and behind the grinder. The tilted elliptical disc configuration also has advantages over a configuration including perpendicularly mounted circular discs. A perpendicularly mounted circular disc configuration will allow pulverized debris to pass between the discs. However, when grinding teeth are mounted upon the outer periphery of perpendicularly mounted circular discs, the planing or grinding profile of the grinder leaves a grooved surface. By mounting grinding teeth upon the outer peripheries of tilted elliptical grinding discs, the cutting swathes of the teeth may be closely spaced or even overlapped, providing a smooth grinding or planing profile while allowing for unrestricted passage of pulverized debris.

Accordingly, it is an object of the present invention to provide a grinder having a tilted elliptical disc configuration which allows pulverized debris to freely pass between the discs rather than causing such debris to accumulate in front of and behind the grinder.

It is a further object of the present invention to provide a tilted elliptical disc configuration grinder allowing for overlapping or closely spaced grinder teeth cutting swathes providing for a smooth grinding or planing profile.

Other and further objects and advantages of the present invention will become apparent to those skilled in the art upon review of the following detailed description and upon review of the appended drawings.

DETAILED DESCRIPTION

The geometric principle underlying the configuration of the present invention is that when an elliptical cylindrical section is viewed along the radial axis of the cylinder cut by the section, the ellipse appears to be a circle. When such an elliptical cylindrical section is rotated about the radial axis of the cylinder, all points on the ellipse remain equidistant from the axis, the rotation defining a regular cylindrical surface. The instant invention duplicates such a rotation of an ellipse about the axis of a cylinder, allowing cutting teeth attached to the outer periphery of the elliptical discs to pass through all points of a regular cylindrical surface.

Figure 1:
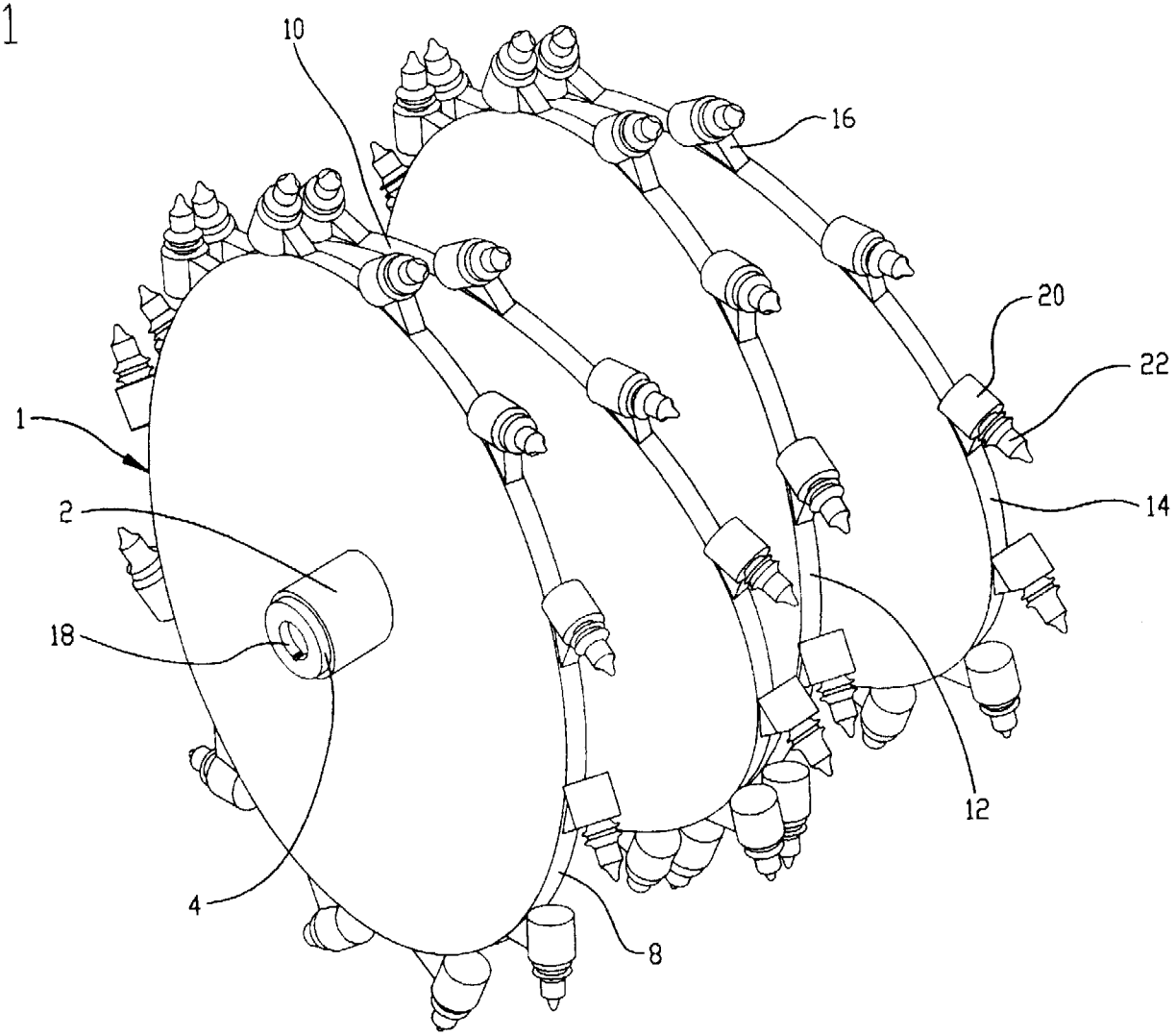
FIG. 1 is a perspective view of the elliptical disc grinder.

Referring now to FIG. 1, the elliptical disc grinder 1 has a cylindrical axle 2, both ends of which are journaled in a single step for rotatable mounting within a grinding machine such a cold planer. An end of the axle 2 has a cylindrical aperture having a key way 18 for engaging a keyed drive shaft, the drive shaft typically being driven by an hydraulic motor.

Referring further to FIG. 1, four elliptical discs 8, 10, 12, and 14 are attached, preferably by welding, to the outer surface of the axle 2. Alternate configurations allow for installation of a greater or lesser number of such elliptical discs. A multiplicity of angled cutting tooth supports 16 are welded to the outer periphery of the elliptical discs 8, 10, 12 and 14. Upon the upper surface of each angled cutting tooth support is welded a tooth driving slug 20, each tooth driving slug 20 having an hardened steel removable and replaceable cutting or grinding tooth 22 mounted within and extending from its forward end.

Figure 2:
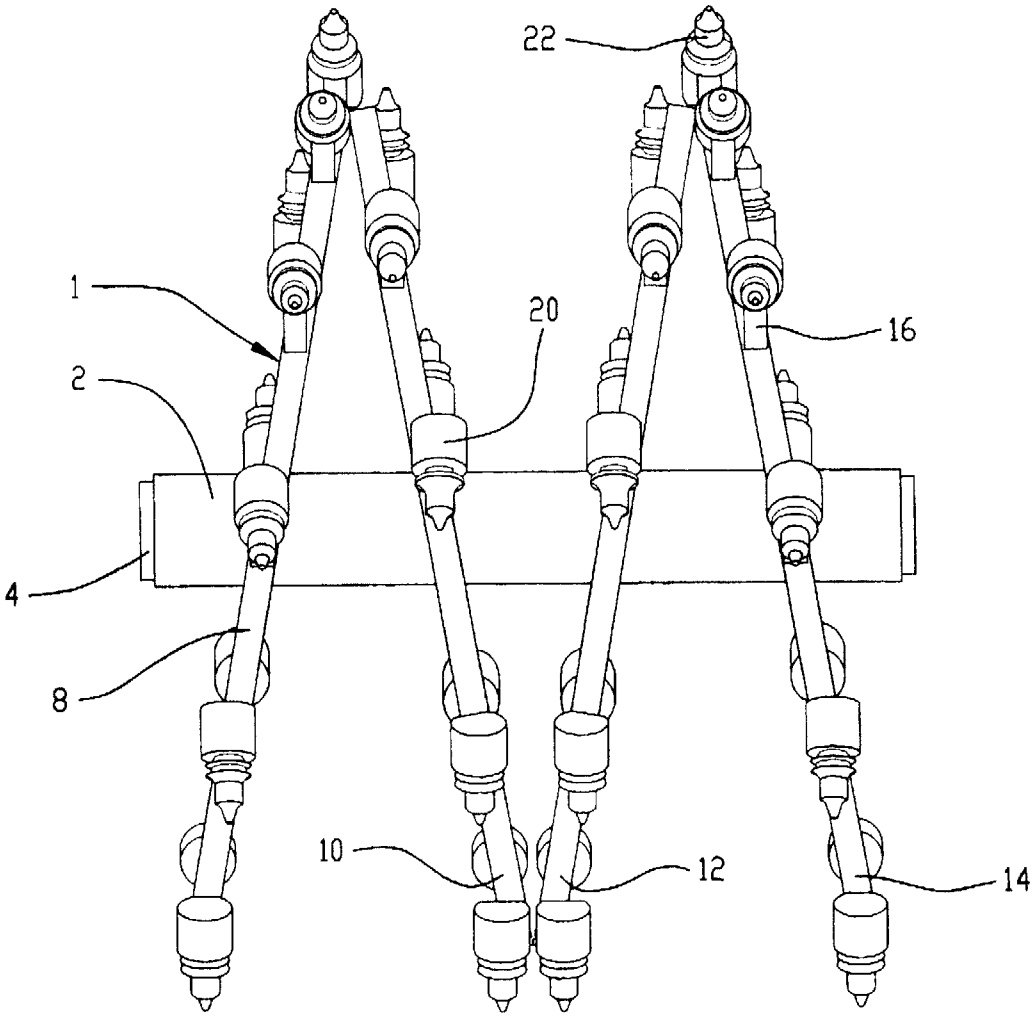
FIG. 2 is a frontal view of the elliptical disc grinder.

FIG. 2 portrays a preferred angular mounting of the elliptical discs 8, 10, 12 and 14 over the axle 2, allowing the cutting swathes of the cutting or grinding teeth 22 to be closely spaced or overlapped while leaving spaces between the elliptical discs 8, 10, 12 and 14 for passage of pulverized debris.

Figure 3:
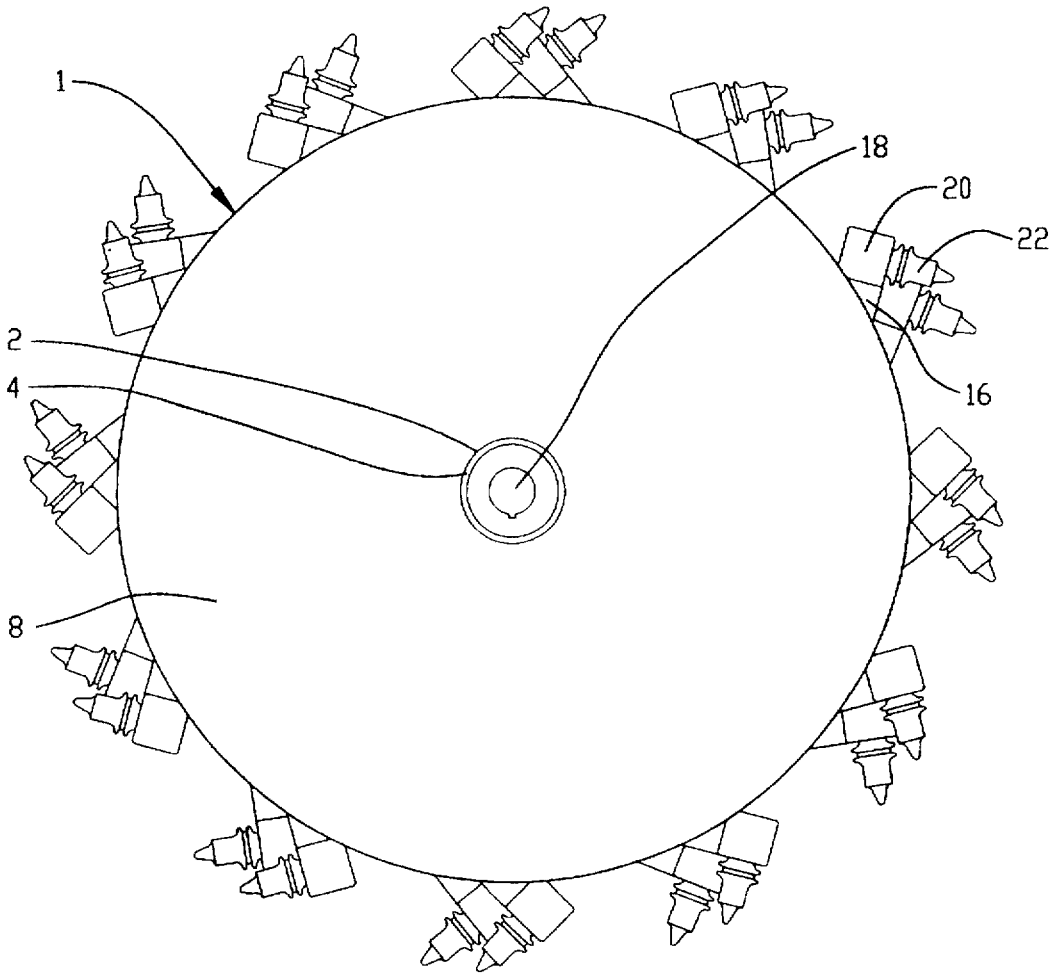
FIG. 3 is a sideview of the elliptical disc grinder.
Figure 4:
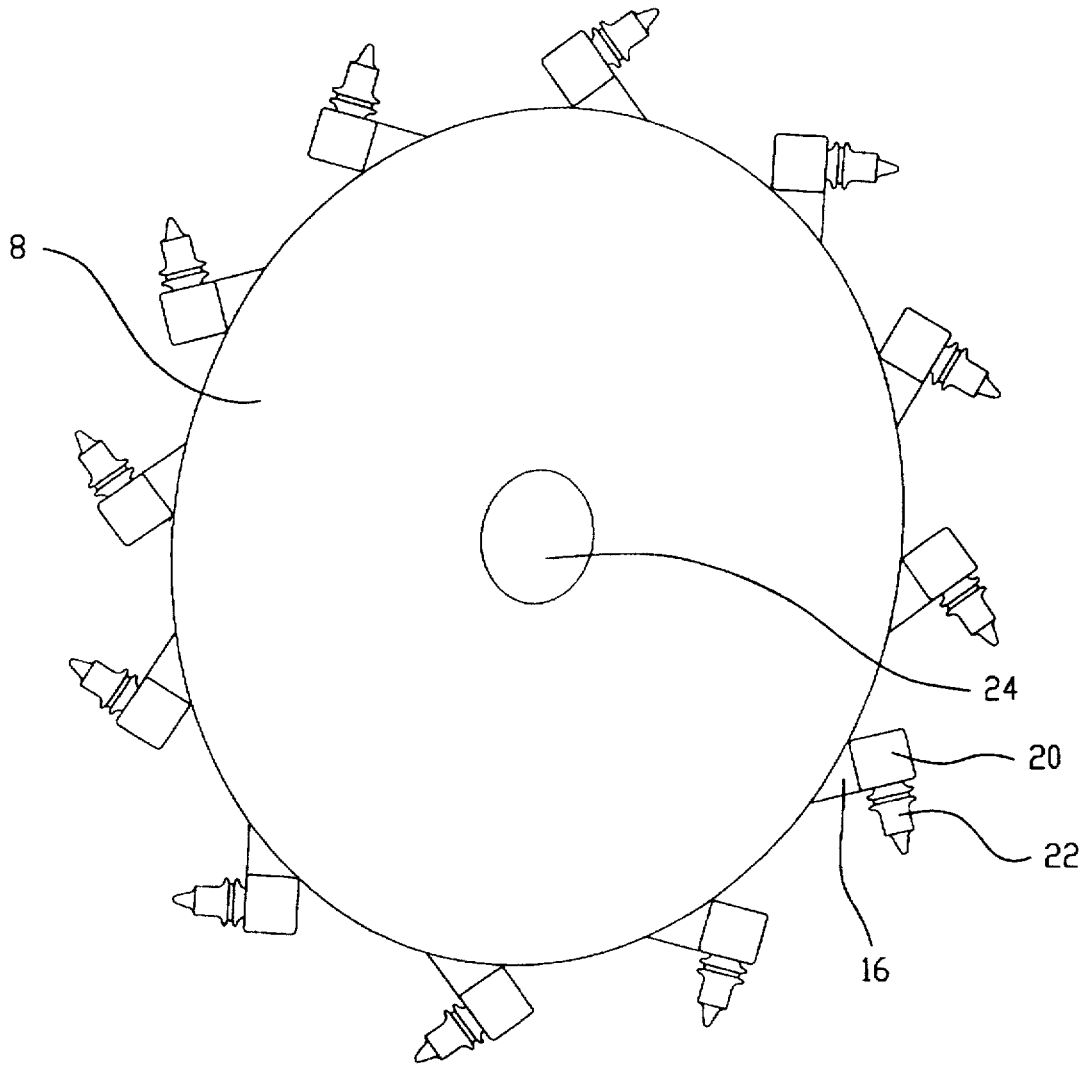
FIG. 4 is a plan view of a single elliptical disc removed from the elliptical disc grinder.

When the elliptical disc grinder 1 is viewed side on, as in FIG. 3, the end disc 8 appears circular, demonstrating the circular paths of the cutting teeth 22. Referring to FIG. 4, each elliptical disc has a central elliptical axle receiving aperture 24. For proper installation of the elliptical disc 8 over a cylindrical axle, the long diameter of the elliptical disc 8 preferably passes through the long diameter of the elliptical disc aperture 24 and the short diameter of the elliptical disc 8 preferably passes through the short diameter of the aperture 24. The ratios of the lengths of the long and short diameters of the disc 8 and the aperture 24 preferably are equivalent. Referring to FIG. 1, discs 10, 12 and 14 preferably have the same configuration.

In operation, referring to FIG. 1, the elliptical disc grinder 1 is placed in contact with a substantially flat surface to be ground or planed such as a concrete or asphalt road surface. The elliptical disc grinder 1 is then forcefully rotated about its central radial axis, preferably by an hydraulic motor. Upon such rotation, grinding or planing of the road surface commences. While grinding is ongoing, the elliptical disc grinder 1 is driven forward, causing the grinding teeth 22 to continuously impinge upon new concrete or asphalt. As forward progression of grinding or planing occurs, the close spacing of the swathes of the grinding or cutting teeth 22 causes a layer of the asphalt or concrete surface to be completely ground away without leaving a grooved surface. Also, as forward progress of grinding or planing occurs, pulverized concrete or asphalt debris passes between the elliptical discs, 8, 10, 12, and 14 rather than accumulating in front or to the rear of such discs.

While there is shown and described herein a certain specific structure embodying the invention, it will be manifest to those skilled in the art that various modifications and rearrangements of the parts may be made without departing from the spirit and scope of the underlying inventive concept, and that the same is not limited to the particular form herein shown and described except in so far as indicated by the scope of the appended claims.

I claim:

1. A grinder comprising:

a rotatable axle having an axis of rotation; a multiplicity of grinding teeth, each grinding tooth having a cutting or grinding surface; and a plurality of grinding teeth suspending means; each grinding teeth suspending means being fixedly attached to the rotatable axle; each grinding tooth being fixedly attached to one of the grinding teeth suspending means; the plurality of grinding teeth suspending means fixedly suspending the multiplicity of grinding teeth around the rotatable axle so that as the rotatable axle rotates about its axis of rotation, the cutting or grinding surface of each grinding tooth orbits circularly around the axis of rotation, each circular orbit having an orbital radius; the plurality of grinding teeth suspending means positioning the multiplicity of grinding teeth so that their cutting or grinding surfaces form a plurality of substantially elliptical patterns, each substantially elliptical pattern having a pair of long radiuses.

2. The grinder of claim 1 wherein, the plurality of grinding teeth suspending means further positions the multiplicity grinding teeth so that the midpoint of each substantially elliptical pattern of cutting or grinding surfaces substantially coincides with the axis of rotation of the rotatable axle; and wherein, the plurality of grinding teeth suspending means further positions the multiplicity of grinding teeth so that the long radiuses of each substantially elliptical pattern of cutting or grinding surfaces extend from the axis of rotation of the rotatable axle at an acute angle.

3. The grinder of claim 2 wherein, the rotatable axle comprises a cylinder having an outside diameter, and wherein the plurality of grinding teeth suspending means comprises a plurality of elliptical discs.

4. The grinder of claim 3 wherein, each of the elliptical discs has an elliptical axle mounting aperture therethrough; each elliptical axle mounting aperture having a short diameter.

5. The grinder of claim 4 wherein, the midpoint of each elliptical axle mounting aperture substantially coincides with the midpoint of the elliptical disc through which the elliptical axle mounting aperture passes; wherein the short diameter of each of the elliptical axle mounting aperture is substantially equal to the outside diameter of the cylinder; and wherein the eccentricity of each elliptical axle mounting aperture is substantially equal to the eccentricity of the elliptical disc through which the axle mounting aperture passes.

6. The grinder of claim 5 wherein, the elliptical discs and multiplicity of grinding teeth are positioned so that the circular orbits of the cutting or grinding surfaces of the multiplicity of grinding teeth are evenly spaced along the length of the circular cylinder.

* * * * *